US005844529A

United States Patent [19]

Bell et al.

[11] Patent Number: 5,844,529

[45] Date of Patent: Dec. 1, 1998

[54] ANTENNA ENCLOSURE WITH A STRESS-FREE CONNECTION ALONG THE LENGTH OF THE RADOME

[75] Inventors: Thomas Edward Bell, Alpharetta; David John Kiesling, Atlanta; Scott Allen Swanburg, Duluth, all of Ga.

[73] Assignee: Electromagnetic Sciences, Inc., Norcross, Ga.

[21] Appl. No.: 834,957

[22] Filed: Apr. 7, 1997

[51] Int. Cl.[6] ..... H01Q 1/42

[52] U.S. Cl. ..... 343/872; 343/372; 343/700 MS; 343/719; 343/873; 333/12; 333/24 C; 333/126

[58] Field of Search ..... 343/872, 700 MS, 343/719, 770, 906, 890; 333/12, 24 C

[56] References Cited

U.S. PATENT DOCUMENTS

| | | | |
|---|---|---|---|
| 4,914,448 | 4/1990 | Otsukla et al. | 343/872 |
| 5,596,337 | 1/1997 | Merenda | 343/770 |
| 5,757,246 | 5/1998 | Johnson | 333/12 |
| 5,757,324 | 5/1998 | Helms et al. | 343/700 MS |

OTHER PUBLICATIONS

"Base Station Antenna: FV 45-12-00NA" Specification, EMS Wireless, Oct. 1996.

"Product Selection Guide 195", Celwave (Radio Frequency Systems, Inc.,), 1995, pp. 119, 123.

*Primary Examiner*—Frank G. Font
*Assistant Examiner*—Layla G. Lauchman
*Attorney, Agent, or Firm*—Jones & Askew, LLP

[57] ABSTRACT

An enclosed antenna assembly having a non-rigid, floating connection between an aluminum tray and a radome along the length of the assembly. The non-rigid, floating connection along the length of the antenna assembly provides a seal that is not damaged or degraded as a result of thermal expansion and contraction of the dissimilar materials. The tray and radome are joined along their length by a tongue and groove type connection, which allows free movement along the major axis. A top end cap provides the only rigid connection between the tray and the radome. A bottom end cap is fastened only to the radome. The design of the keyway and the top end cap prevent direct water intrusion. The bottom end cap includes weep holes to allow condensation to escape from the interior of the antenna assembly.

21 Claims, 7 Drawing Sheets

ANTENNA ENCLOSURE WITH A STRESS-FREE CONNECTION ALONG THE LENGTH OF THE RADOME

TECHNICAL FIELD

The present invention relates to an enclosure for an antenna array, and more particularly relates to an improved radome and tray assembly for mounting and enclosing an antenna array.

BACKGROUND OF THE INVENTION

Antennas of various types are used in modern communications systems, such as cellular mobile radiotelephone systems and Personal Communication Services (PCS) systems. Antennas for these types of systems are mounted outdoors and are subjected to harsh environmental conditions. In some cases, the antenna array is located within an enclosure that protects the antenna array from exposure to direct sunlight, wind, rain, snow, ice, etc.

Enclosed antenna assemblies for PCS and cellular systems typically include an aluminum tray and an extruded plastic radome. The antenna array is first mounted to the aluminum tray, which typically operates as a radio-electric ground plane. The radome is then attached to the aluminum tray to form a sealed enclosure. The entire assembly is then mounted to a pole by means of mounting hardware that fastens to the back of the aluminum tray.

In these types of enclosures, the radome is typically attached to the aluminum tray by rivets. In general, it is desirable for the radome to be tightly attached to the aluminum tray. This requires a large numbers of rivets along the adjoining portions of the tray and radome. Because rivets alone do not provide a perfect seal, an RTV sealing compound is typically used as a water seal.

This type of construction is undesirable in terms of both manufacturing and antenna performance. With respect to manufacturing, the prior art approach requires a fairly large number of rivets, which increases both materials and labor costs. The use of the RTV sealing compound also adds to the cost of the materials and makes assembly more difficult. Once assembled in this manner, it is also very difficult to open the antenna assembly for analysis or repair.

Antennas constructed in this manner are also prone to failures resulting from exposure to extreme temperature cycles. The use of rivets to join the aluminum tray and plastic radome results in a rigid attachment between two materials with different thermal expansion coefficients. For example, the thermal expansion coefficient for aluminum is 23 parts per million per degree centigrade (ppm/° C.), and the thermal expansion coefficient for plastics is on the order of 90 ppm/° C.

The change in length of each material as a function of temperature is given by the formula:

$$\Delta L = L_0 \alpha T,$$

where:

$\Delta L$ is the change in length, $L_0$ is the original length, $\alpha$ is the thermal expansion coefficient, and $\Delta T$ is the change in temperature (in ° C.)

Based on this formula, the difference in the change in length of 56 inch long pieces of aluminum and plastic over a typical temperature range of −40° C. to +70° C. is approximately 0.41 inches.

Thus, prior art antenna enclosures generally rely on two pieces of dissimilar materials that are firmly fastened together, and which expand and contract at very different rates with changes in temperature. This may cause the antenna assembly to act like a bimetallic strip and cause some bending of the aluminum tray. Such bending may result in distortion of the radiation patterns associated with the antenna.

Perhaps more disastrous are the mechanical stresses placed on the rivets and sealing compound as the aluminum tray and the plastic radome expand and contract. When repeated over a period of time, this stress can result in damage to the seal between the aluminum tray and plastic radome, which may allow rain to enter the enclosure. These effects are especially problematic because the operators of PCS and cellular communications systems would, in some cases, like antennas to remain in service for 10 to 15 years.

Thus, there is a need in the art for a improved antenna assembly in which the tray and radome are not rigidly joined together.

SUMMARY OF THE INVENTION

The present invention satisfied the above-described need by providing an improved antenna enclosure in which the tray and radome are joined together using a stress-free connection along the length of the radome, and are rigidly joined to each other only at one end of the assembly. By not rigidly joining the tray and radome along the length of the assembly, the present invention avoids the mechanical stresses and distortion that result from the materials' different thermal expansion coefficients.

Generally described, the present invention provides an antenna assembly that includes a tray and a radome. The tray includes first and second ends and first and second parallel edges. The first and second edges include first and second channels along at least a portion of the first and second edges. The radome includes an exterior and an interior, which includes first and second protrusions along at least a portion of the length of the radome. The first and second protrusions correspond to the first and second channels, and allow the radome to be slidably connected to the tray. The radome and tray are rigidly connected to each other only at the first end.

More particularly described, the present invention includes a first end cap located adjacent the first end of the tray. The first end cap is fastened to the tray and the radome, thereby forming a rigid connection between the tray and radome. A second end cap is located adjacent the second end of the tray and is fastened only to the radome. The first end cap extends outside of the surface formed by the tray and the radome, while the second end cap is recessed within the surface formed by the tray and the radome, and includes a vertical wall that remains in contact with the tray.

In another aspect, the present invention provides a method for manufacturing an antenna assembly. The method includes providing a tray that includes first and second ends and first and second parallel edges, which include first and second channels along their length. A radome is provided, which includes an interior and an exterior, the interior including first and second protrusions along the length of the radome, which correspond to the first and second channels. The method includes sliding the radome on the tray so that the first and second protrusions engage the first and second channels. A top end cap is then positioned adjacent the first end of the tray and attached to the tray and the radome. A bottom end cap is then positioned adjacent the second end of the tray and attached only to the radome.

In view of the foregoing, it will be appreciated that the present invention and its various embodiments will be more fully understood from the detailed description below, when read in connection with the accompanying drawings, and in view of the appended claims.

DETAILED DESCRIPTION

The present invention is directed to an improved antenna assembly or enclosure, in which the tray and radome enjoy free movement along the length of the antenna. The tray and radome are joined along the length of the assembly by a keyway, or tongue and groove-type feature, that allows the different materials to freely expand lengthwise at different rates as they are exposed to temperature cycles. The connection between the tray and radome is formed in a way that prevents water from directly entering the enclosure. Condensation is allowed to escape by means of weep holes in the bottom of the assembly. The tray and radome are rigidly joined only at one end of the assembly.

Because the present invention is directed to mechanical features of the antenna enclosure, the radiating antenna elements and associated electronics are not described in the present application. Information regarding the antenna elements that are mounted in the antenna enclosure is provided in commonly assigned U.S. application Ser. No. 08/733,399, filed Oct. 18, 1996, and entitled "Dual Polarized Array Antenna," which is incorporated herein by reference.

Figure 1:
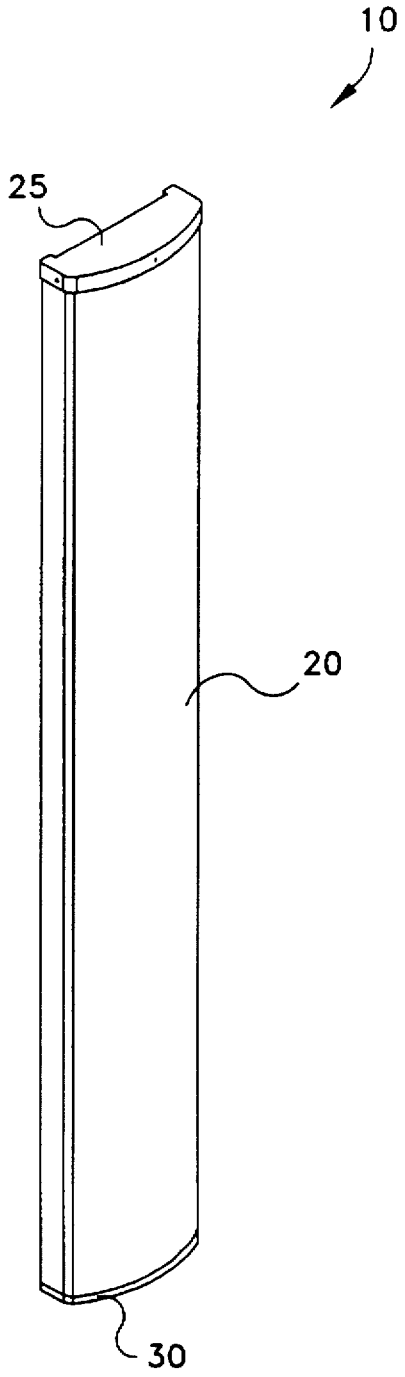
FIG. 1 is a perspective view of an antenna enclosure constructed according to an exemplary embodiment of the present invention.
Figure 2:
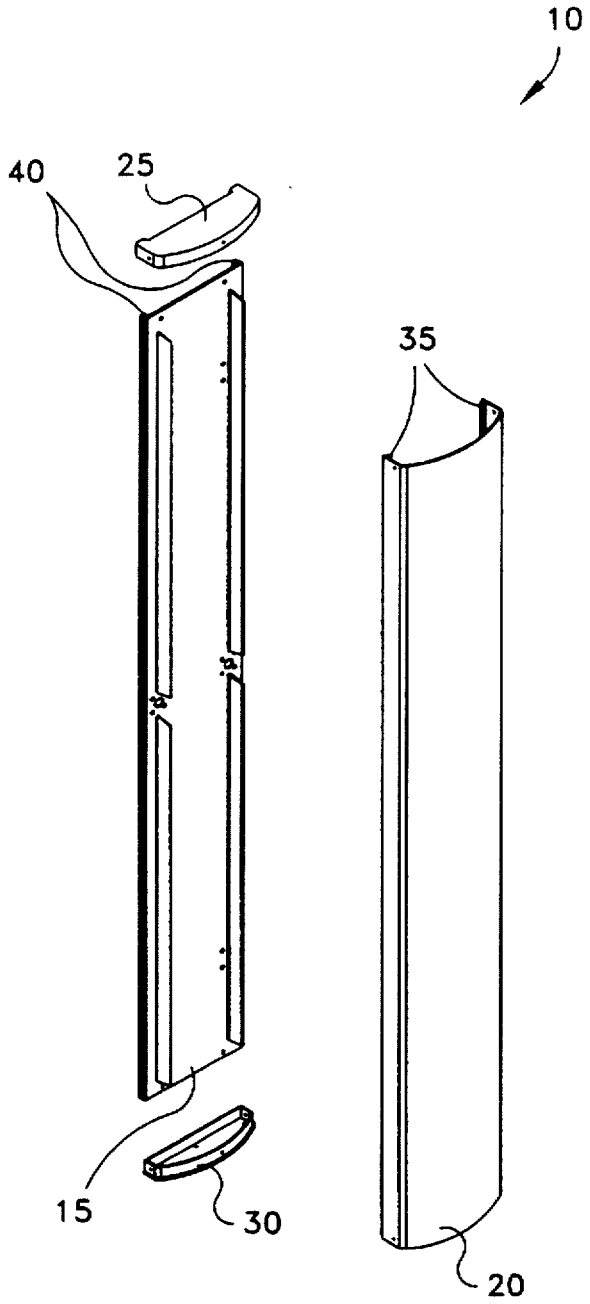
FIG. 2 is an exploded view of the antenna enclosure of FIG. 1.

FIGS. 1 and 2 provide perspective and exploded views of an antenna assembly 10 constructed in accordance with the present invention. In an exemplary embodiment, the antenna assembly 10 includes an aluminum tray 15, a radome 20, a top end cap 25, and a bottom end cap 30. The aluminum tray serves as the antenna's radio-electric ground plane. The antenna assembly is preferably mounted to a pole by means of mounting hardware (not shown), which is fastened to the back of the tray 15. The tray 15 and radome 20 have interlocking features that are designed as part of their cross section or profile to provide stress-free attachment of the two parts.

As illustrated more clearly in FIGS. 3–7, the tray 15 and radome 20 are joined together along the length of the assembly 10 by means of a tongue and groove-type features. In particular, the radome 20 is attached to parallel spaced-apart edges extending along the major dimension of the tray 15 by a keyway mechanism and encloses the front surface of the tray 20 and the antenna elements (not shown) that are typically mounted thereon. The keyway mechanism comprises a protrusion or tongue 35 extending along the edge of each spaced-apart side of the radome 20 and a channel or groove 40 formed along the length of each corresponding edge on the major dimension of the rear surface of the tray 15.

The top end cap 25 and bottom end cap 30 are positioned at the ends of the antenna assembly 10 in order to cover the openings formed by the combination of the tray 15 and radome 20. The antenna assembly is preferably mounted with the top end cap 25 extending outside the surface of the radome at the upper end of the generally vertically oriented assembly. The bottom end cap 30 is recessed. The encapsulation of the antenna within a sealed enclosure formed by the tray 15, the radome 20, and the end caps 25 and 30 provides an optimum configuration for mitigating rain intrusion and protects the antenna elements from environmental effects, such as direct sunlight, water, dust, dirt, and moisture. The bottom end cap 30 includes one or more weep holes 80, which allow the structure to breath, and allow condensation to escape.

The antenna assembly 10 is assembled by first sliding the radome 20 on the tray 15 so that the tongues 35 on the radome 20 engage the grooves 40 on the tray 15. The top end cap 25 is then placed over the opening at the top of the combination of the radome 20 and tray 15. The top end cap 25 is fastened to the tray 15 and to the radome 20, preferably using fasteners, such as rivets. The bottom end cap is then placed over the opening at the bottom and fastened only to the radome, preferably using rivets.

Those skilled in the art will appreciate that the only rigid connection between the tray 15 and the radome 20 is at the top of the assembly, where the top end cap 25 is fastened to both the tray 15 and radome 20. Because the bottom end cap 30 is fastened only to the radome 20 and because the keyway provides a non-rigid connection between the tray and the radome, the tray 15 and radome 20, which have different thermal expansion coefficients, are free to expand and contract at different rates without exerting stress on any connection between the pieces of the assembly 10.

The features of each piece of the antenna assembly 10 will now be discussed in detail in conjunction with FIGS. 3–7.

Figure 3A:
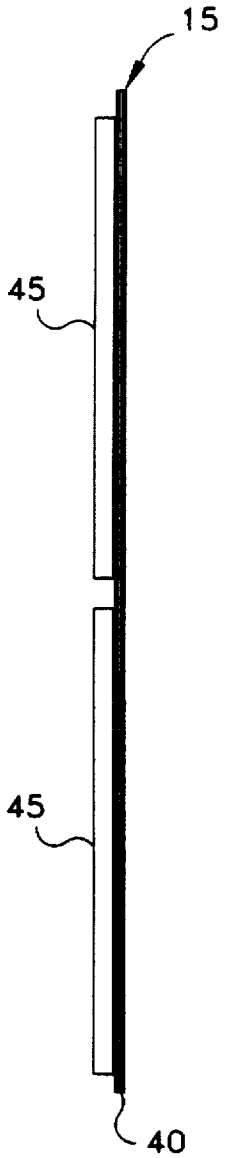
FIG. 3, which consists of FIGS. 3*a* and 3*b*, depicts side and top plan views of a tray, which forms a part of the antenna assembly of FIG. 1.
Figure 3B:
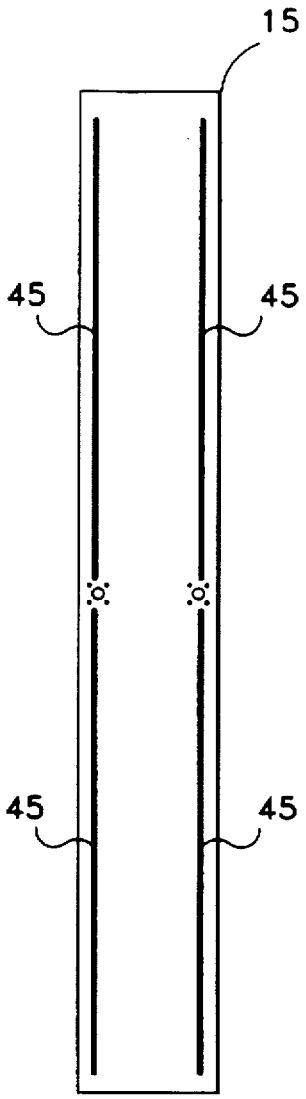
Figure 4A:
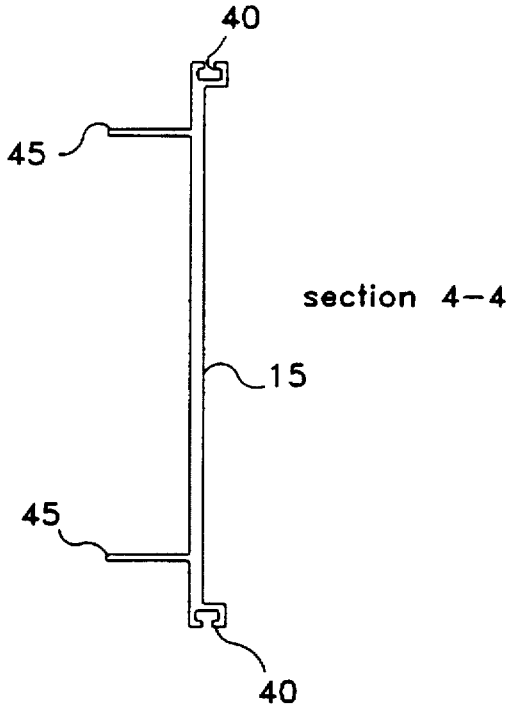
FIG. 4, which consists of FIGS. 4*a* and 4*b*, depicts cross sectional and perspective views of the tray shown in FIG. 3.
Figure 4B:
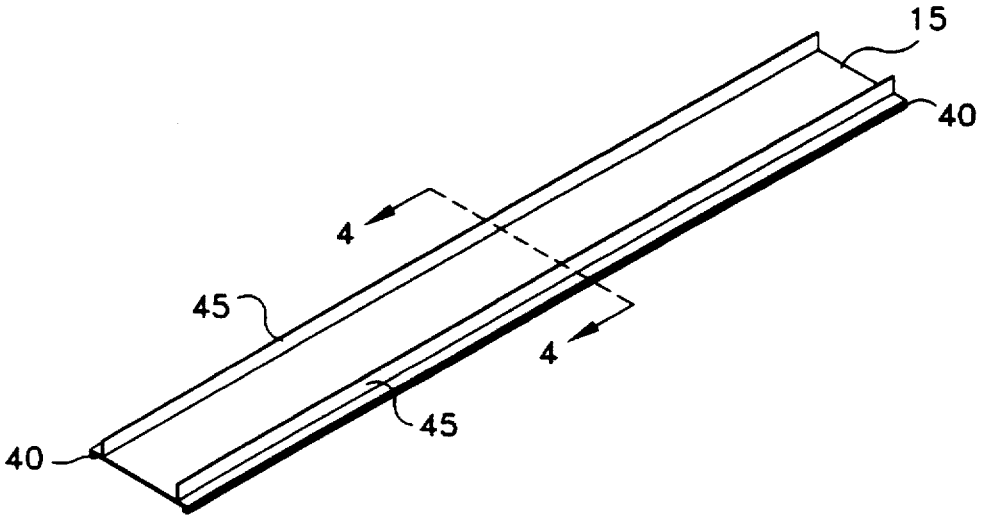

FIGS. 3 and 4 illustrate various aspects of the tray 15. Generally described, the tray 15 is formed from an extruded piece of aluminum, which is illustrated in FIG. 4. FIG. 4*b* is a perspective view of the extruded tray. FIG. 4*a* is a cross-sectional view taken along line 4—4, which clearly shows the construction of the keyway or groove 40 on both sides of the tray. The shape of the groove 40 is designed to hold the tray and radome together, allow free movement between the parts, and prevent direct water penetration.

In an exemplary embodiment, the tray 15 is approximately 0.190 inches thick. The tray 15 includes parallel, spaced apart side walls 45, which are designed to determine the beamwidth of the antenna. Those skilled in the art will appreciate that the beamwidth may be altered by the presence or absence of such side walls, their height, and the distance between them.

After the tray is extruded, it is machined (or processed by other means, such as punching, laser cutting, or drilling) to include mounting holes for the top end cap 25, the antenna array (not shown), and the mounting hardware (not shown), to provide a gap in the side walls 45, and to remove the side walls at the ends of the tray (as illustrated in FIG. 3). The space at the ends of the tray allows room for the top and bottom end caps 25 and 30 to be attached to the ends of the assembly. Other tray designs without side walls (not shown) require only that the holes be included.

Figure 5A:
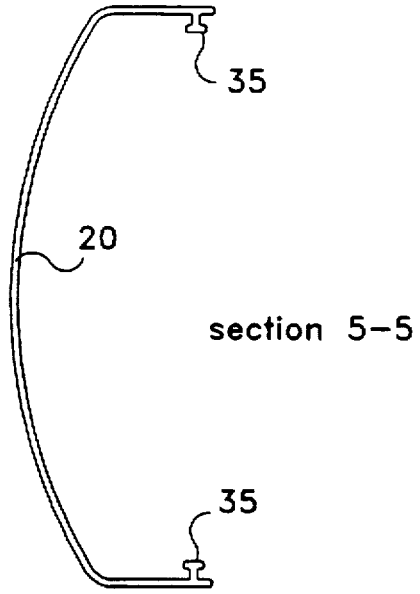
FIG. 5, which consists of FIGS. 5*a* and 5*b*, depicts cross sectional and perspective view of a radome, which forms a part of the antenna assembly of FIG. 1.
Figure 5B:
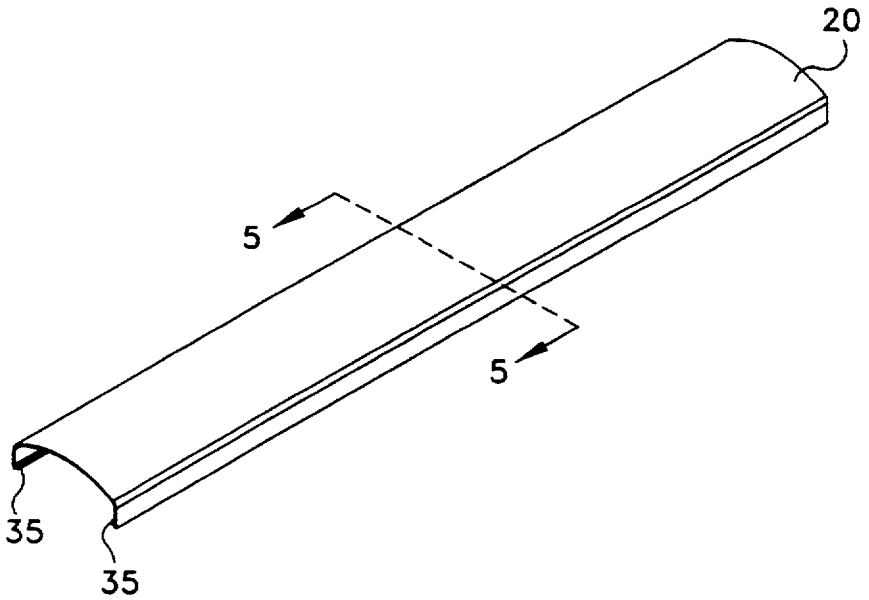

FIG. 5 illustrates the radome 20, which is preferably extruded from PVC. FIG. 5*a* is a cross sectional view of the radome 20 taken along lines 5—5. FIG. 5*b* is a perspective view of the extruded radome 20. In an exemplary embodiment, the width of the radome is approximately 8 inches, and the thickness is approximately 0.1 inch. This thickness provides sufficient rigidity to prevent damage to the internal elements when the antenna assembly is impacted from the front, while also minimizing the effects on the transmission of radio frequency energy through the radome for the PCS application design.

Figure 6:
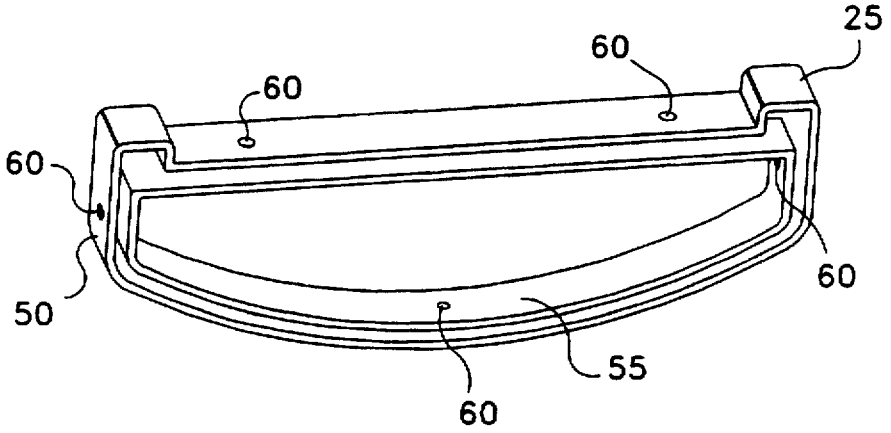
FIG. 6 is a perspective view of an end cap, which forms a part of the assembly of FIG. 1.

FIG. 6 is a perspective view of the top end cap 25, which is injection molded from "GELOY" brand acrylic styrene acrylonitrile (ASA). The top end cap 25 includes exterior vertical walls 50 and interior vertical walls 55, which include a plurality of holes 60 for allowing rivets to be used to connect the top end cap to the tray 15 and radome 20. When the top end cap is placed on the tray and radome, the tray and radome extend upward into the channel formed by the interior and exterior vertical walls 50 and 55. Rivets are then inserted through the holes 60 and predrilled holes in the tray 15 and radome 20 (not shown) in order to fasten the top end cap to the radome 20 and tray 15. This connection forms the only rigid connection between the radome 20 and tray 15.

Figure 7:
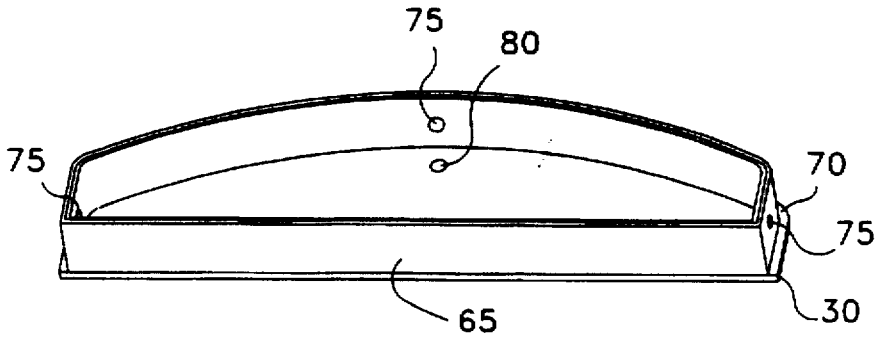
FIG. 7 is a perspective view of another end cap, which forms a part of the assembly of FIG. 1.

FIG. 7 is a perspective view of the bottom end cap 30, which is also injection molded from "GELOY" brand plastic material. The bottom end cap 30 includes vertical walls 65 and a lip 70. The vertical walls includes a plurality of holes 75 for allowing rivets to be used to connect the bottom end cap to the radome 20. The bottom end cap 30 also includes one or more weep holes 80 in order to allow condensation to escape from the enclosure. When the bottom end cap is attached to the tray and radome, the tray and radome are located on the exterior of the vertical walls 65, and above the lip 70. Rivets are then inserted through the holes 75 and predrilled holes in the radome 20 (not shown) in order to fasten the bottom end cap to the radome. Thus, this connection does not form a rigid connection between the radome 20 and tray 15. The height of the vertical wall 65 must be sufficient to ensure that when the radome expands to its greatest length, the tray 15 and vertical wall 65 will continue to overlap and provide an adequate enclosure at the bottom of the antenna assembly 10. In other words, the bottom end cap's lip overlaps the tray, and is sufficiently large to maintain closure in spite of thermal expansion.

From the foregoing description of each component of the antenna assembly, those skilled in the art will appreciate that the present invention provides an antenna assembly that prevents direct intrusion of water, while eliminating the destructive mechanical stress that results from different thermal expansion coefficients. This is accomplished by providing a non-rigid connection between the tray and radome along the length of the antenna assembly, which is the dimension with the largest differential thermal expansion. The tongue and groove connection between the tray and radome allows a true floating design and provides a good weather seal without the need for a sealant. The top end cap includes vertical walls that are located on the exterior of the tray and radome in order to shed water without allowing it to reach the interior of the antenna assembly. The bottom end cap is recessed in the interior of the tray and radome so water doesn't collect at the bottom end cap. The bottom cap also includes weep holes that allows any condensation to drain from the interior of the antenna assembly. The only rigid connection between the tray and radome are adjacent the top end cap, thereby allowing the radome and tray to expand and contract independently without producing harmful mechanical stress on the connections between the antenna components.

Those skilled in the art will also appreciate that the present invention is applicable to antennas having an aspect ratio of the major and minor physical dimensions greater than unity. Because the radome shape is nonuniform (i.e., curved or bowed) in the minor dimension, any differential change in the minor dimension can be absorbed by the radome by its becoming more or less bowed. Given the features of the tongue and groove design, this change in shape does not impart any significant stress in the tray. Because the radome shape is uniform (i.e., straight) in the major dimension, it cannot absorb differential change in the major dimension by bowing. Differential change in the major dimension is best dealt with by providing for stress free movement between the components. Thus, the utility of the invention is best for an antenna having a radome shape that is non-uniform in the minor dimension and uniform in the major dimension.

It will be understood that only the claims that follow define the scope of the present invention and that the above description is intended to describe embodiments of the present invention. In particular, the scope of the present invention extends beyond any specific embodiment described within this specification.

What is claimed is:

1. An antenna assembly, comprising:

a tray including first and second ends and first and second parallel edges, said first and second edges including first and second channels along at least a portion of said first and second edges; and a radome including an interior and an exterior, said interior including first and second protrusions along at least a portion of the length of said radome, said first and second protrusions corresponding to said first and second channels, and being operative for slidably connecting said radome to said tray, said tray and said radome being rigidly connected only at said first end.

2. An antenna assembly as recited in claim 1, further comprising a first end cap located adjacent said first end of said tray, said first end cap being fastened to said tray and said radome.

3. An antenna assembly as recited in claim 2, wherein said first end cap extends outside of the surface formed by said tray and said radome.

4. An antenna assembly as recited in claim 2, further comprising a second end cap located adjacent said second end of said tray, said second end cap being fastened only to said radome.

5. An antenna assembly as recited in claim 4, wherein said second end cap is recessed within the surface formed by said tray and said radome.

6. An antenna assembly as recited in claim 4, wherein said second cap comprises a vertical wall that remains in contact with said tray.

7. An antenna assembly as recited in claim 4, wherein said second cap comprises weep holes.

8. An antenna assembly as recited in claim 1, wherein said tray comprises a conductive material and said radome comprises a non-conductive material.

9. An antenna assembly as recited in claim 1, wherein said first and second channels and said first and second protrusions form tongue and groove connections.

10. An antenna assembly, comprising:

a tray including first and second ends and first and second parallel edges, said first and second edges including first and second channels along the length of said first and second edges;

a radome including an interior and an exterior, said interior including first and second protrusions along the length of said radome, said first and second protrusions corresponding to said first and second channels, wherein said radome is connected to said tray by sliding said first and second protrusions within said first and second channels;

a first end cap located adjacent said first end of said tray, said first end cap being fastened to said tray and said radome; and a second end cap located adjacent said second end of said tray, said second end cap being fastened only to said radome.

11. An antenna assembly as recited in claim 10, wherein said tray comprises a conductive material and said radome comprises a non-conductive material.

12. An antenna assembly as recited in claim 10, wherein said first and second channels and said first and second protrusions form tongue and groove connections.

13. An antenna assembly as recited in claim 10, wherein said first end cap is a top end cap and extends outside of the surface formed by said tray and said radome.

14. An antenna assembly as recited in claim 10, wherein said second end cap is a bottom end cap and is recessed within the surface formed by said tray and said radome.

15. An antenna assembly as recited in claim 10, wherein said second end cap comprises a vertical wall that remains in contact with said tray.

16. A method for manufacturing an antenna assembly, comprising the steps of:

providing a tray including first and second ends and first and second parallel edges, said first and second edges including first and second channels along the length of said first and second edges;

providing a radome including an interior and an exterior, said interior including first and second protrusions along the length of said radome, said first and second protrusions corresponding to said first and second channels, and being operative for slidably connecting said radome to said tray;

sliding said radome on said tray so that said first and second protrusions engage said first and second channels;

positioning a top end cap adjacent said first end of said tray and attaching said top end cap to said tray and said radome; and positioning a bottom end cap adjacent said second end of said tray and attaching said bottom end cap only to said radome.

17. A method for manufacturing an antenna assembly as recited in claim 16, wherein said tray comprises a conductive material and said radome comprises a non-conductive material.

18. A method for manufacturing an antenna assembly as recited in claim 16, wherein said first and second channels and said first and second protrusions form tongue and groove connections.

19. A method for manufacturing an antenna assembly as recited in claim 16, wherein said top end cap extends outside of the surface formed by said tray and said radome.

20. A method for manufacturing an antenna assembly as recited in claim 16, wherein said bottom end cap is recessed within the surface formed by said tray and said radome.

21. A method for manufacturing an antenna assembly as recited in 16, wherein said bottom cap comprises a vertical wall that remains in contact with said tray.

* * * * *